US005924970A

United States Patent [19]

Wingate

[11] Patent Number: 5,924,970

[45] Date of Patent: Jul. 20, 1999

[54] DEVICE FOR PRELOADING A TORQUE LOADED MECHANISM ON A FOLDING CYLINDER

[75] Inventor: Mark Anthony Wingate, Rochester, N.H.

[73] Assignees: Heidelberger Druckmaschinen AG, Heidelberg, Germany; Heidelberg Harris, Inc., Dover, N.H.

[21] Appl. No.: 08/655,503

[22] Filed: May 30, 1996

[51] Int. Cl.[6] ..... B42C 1/00

[52] U.S. Cl. ..... 493/424; 493/425; 270/47

[58] Field of Search ..... 493/357, 358, 493/425, 426, 427, 428, 429, 431, 432; 270/42, 45, 47, 50, 60

[56] References Cited

U.S. PATENT DOCUMENTS

| | | | |
|---|---|---|---|
| 2,435,881 | 2/1948 | Faeber | 493/429 X |
| 2,624,572 | 1/1953 | Harless | 493/431 |
| 2,991,072 | 7/1961 | Deitrich . | |
| 3,455,547 | 7/1969 | Rudolph et al. . | |
| 3,865,361 | 2/1975 | Neal | 493/431 |
| 4,381,106 | 4/1983 | Loebach | 270/60 X |
| 4,892,036 | 1/1990 | Lange | 101/240 |
| 5,096,175 | 3/1992 | Lange et al. | 493/425 X |
| 5,522,586 | 6/1996 | Bunnett et al. | 493/432 X |

FOREIGN PATENT DOCUMENTS

| | | |
|---|---|---|
| 57-175662 | 10/1982 | Japan . |
| 1 542 554 | 3/1979 | United Kingdom . |
| 1 569 545 | 6/1980 | United Kingdom . |

*Primary Examiner*—Joseph J. Hail, III
*Assistant Examiner*—Anthony Ojini
*Attorney, Agent, or Firm*—Kenyon & Kenyon

[57] ABSTRACT

A cylinder in a folding apparatus includes a plurality of product seizing devices. Each product seizing device includes a cam and a shaft having a plurality of product seizing devices attached thereto. A cam follower is mounted to the shaft and a torsion bar is coupled to the cam follower. A torque preloading element for applying a preloaded torque to the torsion bar is provided which maintains the cam follower in contact with the cam. Finally, mechanism for incrementally adjusting and maintaining the preloaded torque on the torsion bar is provided. A variety of mechanisms for incrementally adjusting the preloaded torque are possible. For example, the mechanism may include a first facial toothing on an interior face of the torque preloading element and a second facial toothing on an exterior face of an opposing element. The opposing element is mounted to a work side end of the cylinder and the first facial toothing engages the second facial toothing. The preloaded torque on the torsion bar is incrementally adjusted by relative movement between the first and second facial toothings.

12 Claims, 8 Drawing Sheets

19
21
73
20
16
18
15
25
42
74
72
470
11
34
31
32
27
30
33
26
22
23

DEVICE FOR PRELOADING A TORQUE LOADED MECHANISM ON A FOLDING CYLINDER

FIELD OF THE INVENTION

The present invention relates to a device for quickly and accurately pretensioning a tensioning mechanism on a folding cylinder, and, particularly on folding cylinders having a plurality of torsion bars distributed over their outer circumference.

BACKGROUND OF THE INVENTION

GB 1 542 554 purports to disclose a folding cylinder for rotary printing machines. Two discs on an axle form a rigid axle body in which folding jaws are mounted. The folding jaws, through a spindle and lever, are operated by a roller running on a control cam.

GB 1 569 545 purports to disclose a web-fed rotary printing press. At least one jaw folder unit is assigned to the rotary printing press, the jaw folder unit being capable of being changed over from straight run production to collect-run production and vice versa. Compression springs, resting on the body of the folding jaw cylinder hold control rollers against the cam surface of a control cam which is fixed to the side frame. The folding members are activated by the rollers running on the cam.

U.S. Pat. No. 4,381,106 purports to disclose a collect cylinder for a rotary folder. A folder collect cylinder comprises at least five gripper mechanisms and an equal number of tucking mechanisms controlled by non-rotating cams that are selectively masked by masking cams that rotate about coincidence with the cylinder axis. The masking cams are driven from the main collect cylinder drive through a transmission that can be adjusted to change the speed ratio of the masking cams to the collect cylinder and the phase of the masking cams to the gripper mechanism to provide non-collect, two-collect, three-collect and partial-collect without ever masking the taking surface of the non-rotating gripper cam during a taking phase of any gripper mechanism.

U.S. Pat. No. 4,892,036 purports to disclose a combination collecting and folding cylinder system. To permit central control of the shifting of folding blades and puncture needles on a combination collection or assembly and folding cylinder, the cams have associated therewith rotatable cam cover discs, which are driven from the main machine drive, for example via a drive gear coupled to the cylinder. An additional rotary motion is superimposed to permit shifting of the cover discs and thus selectively different modes of operation for collecting or assembly, or non-collection of sequential sheet products placed on the cylinder. The superimposed motion arrangement comprises a hollow coupling gear which is coupled to a worm gear coupled therewith, the worm gear being engaged by axially shiftable roller bolts, the axial position of which is controllable by an electrical position motor via a shifting plate upon rotation of a positioning spindle.

SUMMARY OF THE INVENTION

In the art of large folding cylinders or folding apparatuses such as collect cylinders, transfer cylinders, tucking blade cylinders, and jaw cylinders it has proven difficult to apply a preload torque to torsion bars for tucking blades, grippers, pin bars, and the like.

Existing clamps for torsion bars utilize collar designs which, due to internal friction, do not fully release the clamping force. This results in some of the preload torque on the torsion bar remaining, even in an unclamped position. Attempts to reapply a preload torque to the torsion bar result in an inaccurate setting of the preload torque due to the internal friction of the collar designs currently used. Consequently, the torque required to overcome the friction varies from torsion bar center to torsion bar center around the cylinder. The torque applied to preload the torsion bar must be higher than the torque desired at the cam follower in order to overcome the internal friction of the collar design. After preloading the torsion bar and locking the clamp of the torsion bar to maintain the preload torque, the torque must be verified on the opposite end of the torsion bar, i.e., on the gear side of the folding cylinder whose torsion bars are currently being preloaded. If the preload measured is unacceptable, the collar must be released and the process repeated. Thus, preloading of a torque on the torsion bar is a time consuming and tedious process.

Large diameter folding cylinders, such as tucking blade cylinders can have up to seven gripper bars and seven tucking blades assigned to their circumference. This results in fourteen torsion bars to be preloaded. Similarly, jaw cylinders may include up to seven moveable jaw members. Therefore, this time consuming torque preloading and verifying process is an obstacle to the quick installation and maintenance of folding apparatuses.

In accordance with the present invention, a cylinder in a folding apparatus includes a plurality of product seizing devices. Each product seizing device includes a cam and a shaft having a plurality of product seizing devices attached thereto. A cam follower is mounted to the shaft and a torsion bar is coupled to the cam follower. A torque preloading element for applying a preloaded torque to the torsion bar is provided which maintains the cam follower in contact with the cam. Finally, a mechanism for incrementally adjusting and maintaining the preloaded torque on the torsion bar is provided. A variety of mechanisms for incrementally adjusting and maintaining the preloaded torque are possible. Moreover, separate mechanisms may be used for adjusting and maintaining the preloaded torque.

In accordance with a first embodiment of the present invention, the mechanism for incrementally adjusting and maintaining the preloaded torque includes a first facial toothing on an interior face of the torque preloading element and a second facial toothing on an exterior face of an opposing element. The opposing element is mounted to a work side end of the cylinder and the first facial toothing engages the second facial toothing. The preloaded torque on the torsion bar is incrementally adjusted by relative movement between the first and second facial toothings.

In accordance with a second embodiment of the present invention, the mechanism for incrementally adjusting and maintaining the preloaded torque includes a ratchet having an outer circumferential toothing which is mounted to the torsion bar. A pawl engages one or more teeth of the ratchet and the preloaded torque on the torsion bar is incrementally adjusted by relative movement between the outer circumferential toothing and the pawl.

In accordance with a third embodiment of the present invention, the mechanism for incrementally adjusting and maintaining the preloaded torque includes an adjustment member attached to the work side end of the torsion bar, an eccentric, and a latch. The adjustment member has a radially extending arm. The latch has a first end which engages an outer end of the radially extending arm, and has a second end which engages the eccentric. Movement of the eccentric incrementally adjusts the preloaded torque on the torsion bar by changing the position of the radially extending arm.

In accordance with the present invention, the preloaded torque on the torsion bar can be finely tuned. For example, it has been found that for the first and second embodiments, the pitch of the toothing can be set to provide a preload torque variation of +/−5 ft lbs per tooth. By accurately setting the preloaded torque, premature wear on cam followers and bearings due to high or low preload torques is prevented. Since a predefined torque can be applied, maintained, and adjusted within a very precise and narrow range, the operator can perform incremental adjustments rather than essentially reapplying the torque from zero. Incremental adjustment of the torque, in turn, allows the torque at each torsion bar to be finely tuned so that consistent torque settings from one torsion bar to another around the cylinder can be achieved.

In addition since torque tolerances are critical in high speed operation, the precise adjustment of the torque provided by the present invention allows folders to operate at extremely high speeds, e.g. up to 3000 fpm.

DETAILED DESCRIPTION OF THE INVENTION

Figure 1:
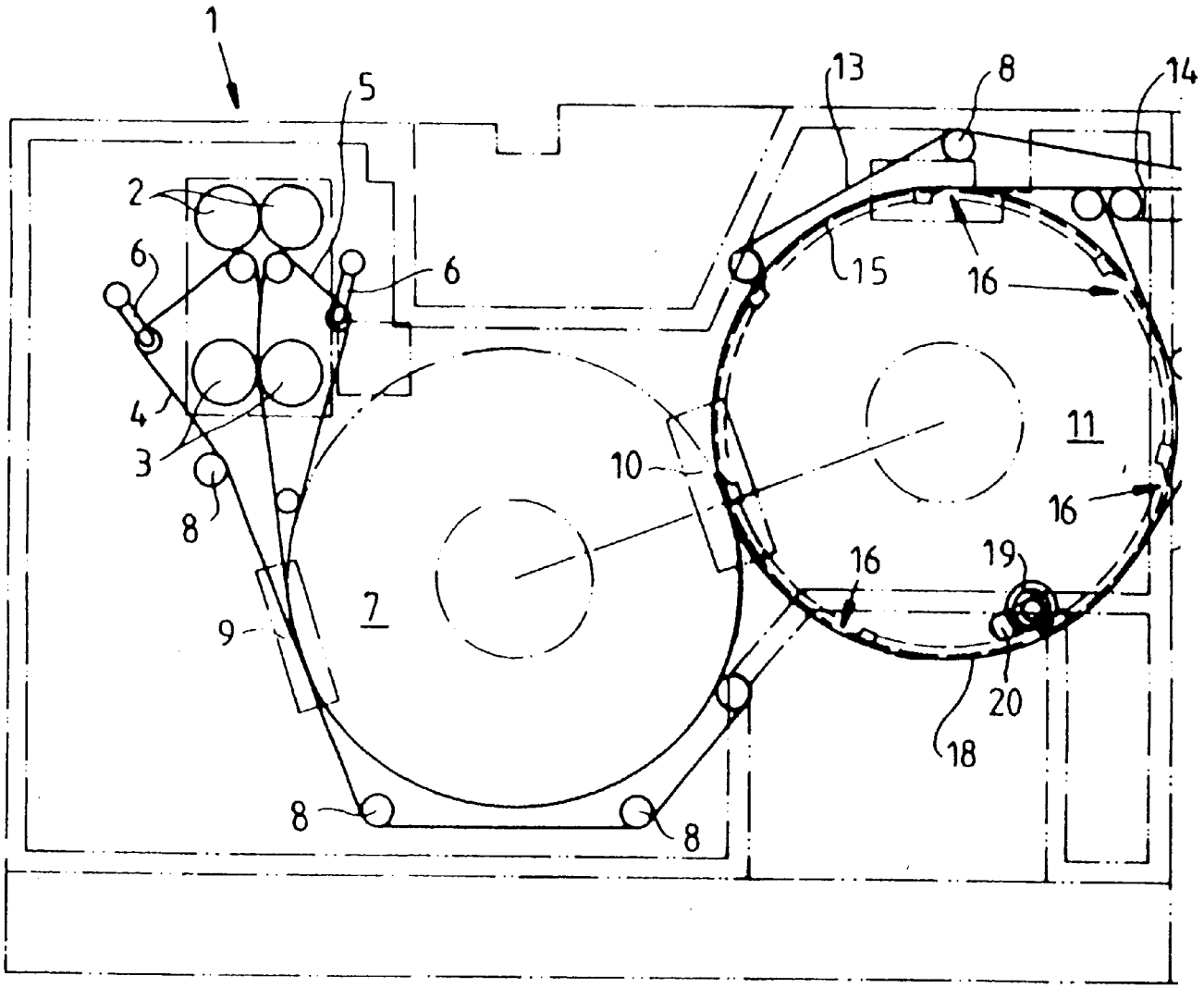
FIG. 1 shows a side view of a folder apparatus according to the present invention having a product seizing device located in front of a fold-off area.
Figure 2A:
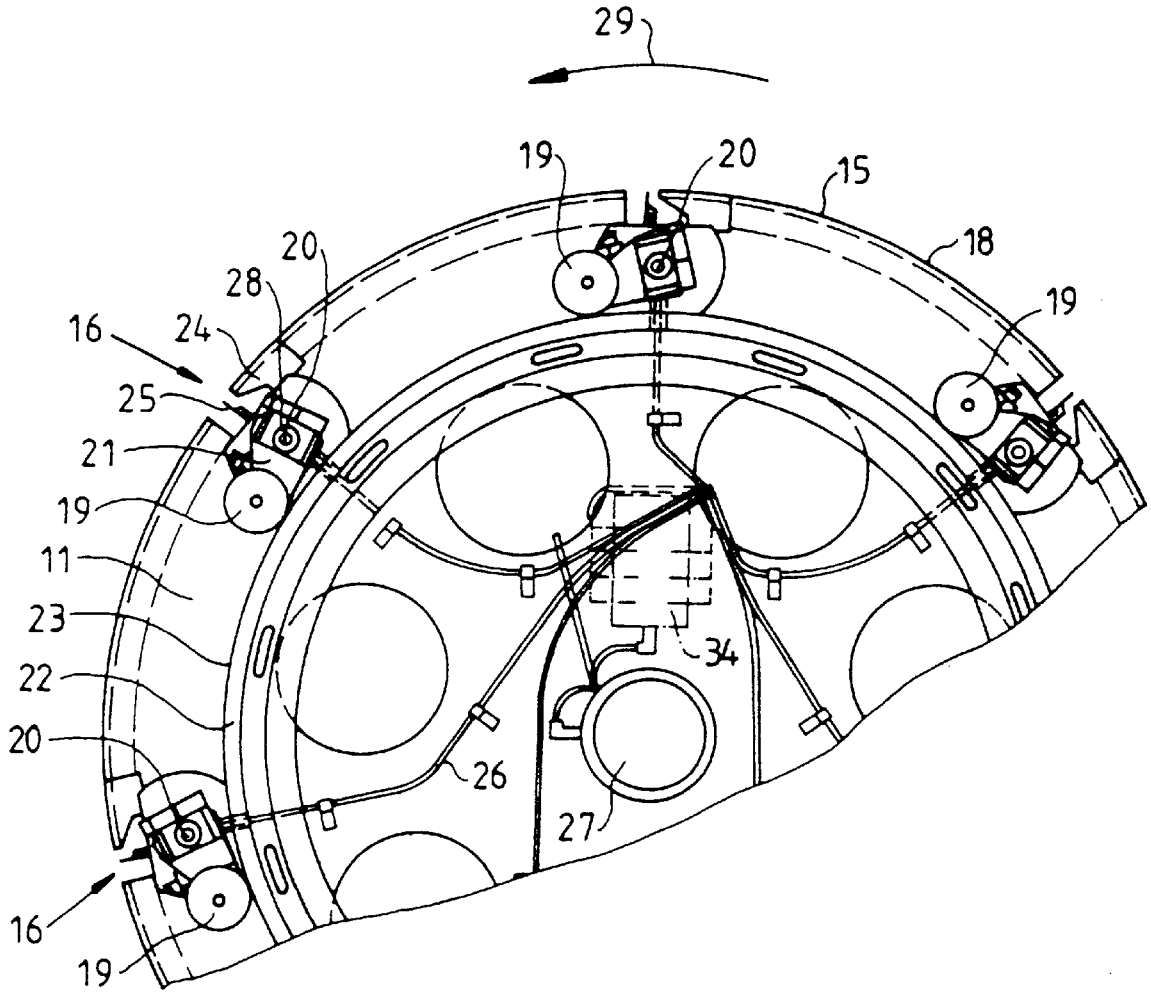
FIG. 2*a* shows a jaw cylinder in partial end view.

FIGS. 1 and 2*a* illustrate a folder apparatus within which the present invention may be employed. FIG. 1 shows a side view of the folder apparatus including folding cylinders for the simultaneous transport of a plurality of samples. After printed products have been cut from a web of material by a pair of cutting cylinders 2, they pass between a set of first conveyor tapes 4 and a set of second conveyor tapes 5. The set of first conveyor tapes 4 are guided partially around the circumference of the product guiding cylinder 7 via a plurality of rollers 8. To maintain a pretensioned state within the first and second conveyor tapes 4, 5, each set of tapes includes a tensioning mechanism 6 of known construction. The products are held against the circumference of a product guiding cylinder 7 by the set of first conveyor tapes 4 and captured by gripping elements (not shown) on the circumference of a product guiding cylinder 7. Tucking blades (not shown) on the product guiding cylinder cooperate with folding jaws 16 on the jaw cylinder 11 to transfer the printing products to the jaw cylinder 11 at a transfer area 10. The gripping elements, tucking blades, and folding jaws are actuated by respective cam followers which are held to the surface of respective cams by preloaded torsion bars. It should be understood that while FIG. 1 illustrates a transfer cylinder and a jaw cylinder, other applications are also contemplated.

Adjacent to the product guiding cylinder 7 is shown a jaw cylinder 11. Folding jaws 16 arranged on the cylinder surface 18 of the jaw cylinder 11 are not shown in detail. Each folding jaw 16 includes movable jaws (not shown) which are actuated by cam followers 19. The cam followers 19 are held to a surface of an actuating cam via a preloaded torque applied to torsion bars 20.

FIG. 2*a* shows a partial side view of the cylinder 11 in greater detail. The outer surface 18 of the cylinder 11 includes circumferentially extending grooves 15. Seven rows of folding jaws 16 are arranged around the surface 18. Each folding jaw 16 includes a set of stationary jaws 24 and a set of moveable jaws 25. Each set of moveable jaws 25 is actuated by a cam follower 19. The surface of the cam follower 19 runs on a cam surface 23 of a cam 22. The cam follower 19 is forced onto the outer circumference 23 of the cam 22 by a torsion bar 20 assigned to the moveable jaws 25. This torsion prevents lift-off of the cam follower 19 from the cam surface 23 which can be caused by high centrifugal forces created by the rotating cylinder 11. The preload torque applied to the torsion bar 20 is transmitted to the cam follower 19 by a lever 21. The amount of the preload torque applied to the torsion bar 20 is preferably low enough to prevent bearings and cam followers from wearing out prematurely, and high enough to prevent the cam followers 19 from lifting-off at high speeds. For example, in the configuration shown in FIG. 2*a*, the preload torque applied to the torsion bar 20 generally varies, for example, between 85 and 95 ft lbs, for each torsion bar 20 assigned to the cylinder 11. The cylinder 11 rotates about an axis 27 in a direction 29. The cylinder 11 includes an oil supply 26 assigned to bearings on each set of moveable jaw members 25. While the above embodiment has been illustrated with regard to a jaw cylinder, it should be understood that tucking blades, gripper elements, or pins can be substituted for the jaws 24, 25 of FIG. 2*a*.

Figures 2B, 2C:
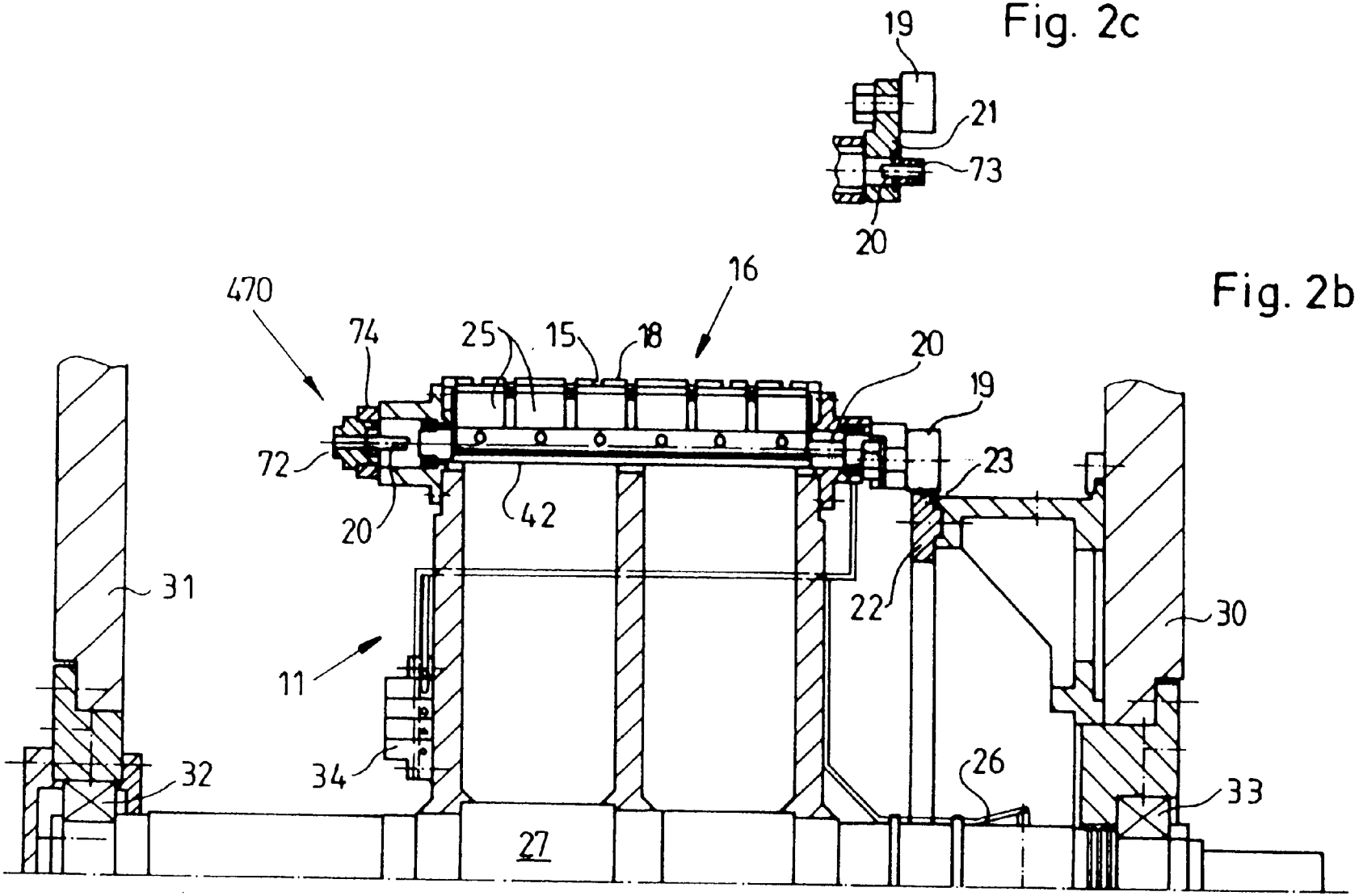
FIGS. 2*b*, 2*c* show the jaw cylinder of FIG. 2*a* journalled in side frames of a folding apparatus.

FIGS. 2*b, c* show two views of a longitudinal section of the cylinder 11 having a prior art torque loading mechanism 470 which includes a first hexagonal element 72 and a collar 74. The cylinder 11 is journalled in respective bearings 32, 33 in the workside and gearside frames 31, 30. The bearings 32, 33 are mounted on the axis of rotation 27. An oil distributor 34 connected to an oil supply 26 maintains bearing lubrication within the cylinder 11. Arranged on the gearside frame 30 is a cam 22 mounted in a support. The cam 22 has a cam surface 23 for supporting the cam follower 19. The set of moveable jaws 25 are arranged on a shaft mounted in the outer circumference of the jaw cylinder 11. A torsion bar 20 extends from the gear side end (i.e. the end closest to the gear side frame 30) of the cylinder to the work side end of the cylinder. A first hexagonal element 72 for applying a preloaded torque is mounted to the work side end of the torsion bar 20 and a second hexagonal element 73 for verifying a preloaded torque is mounted to the gear side end of the torsion bar 20. A collar 74 is mounted to the work side end of the cylinder 11. In order to preload a torque to the torsion bar 20, a torque wrench is used to apply a predetermined torque to the first element 72. Once the predetermined torque is reached, the collar 74 locks the torsion bar 20 in place. Then the torque wrench is applied to the second element 73 to verify the torque on the gear side end of the torsion bar 20. If the torque on the gear side end is incorrect, then the collar 74 is unlocked, the tension on the torsion bar is released, and the process must be repeated. Moreover, as set forth above, with this design, the preloaded torque on the torsion bar 20 is not fully released when the collar 74 is unlocked. In addition, the torque required to overcome the internal friction of the collar varies from torsion bar to torsion bar around the cylinder. Moreover, the torque applied to preload the torsion bar must be higher than the torque desired at the cam follower 19 in order to overcome the internal friction of the collar design.

Figure 3B:
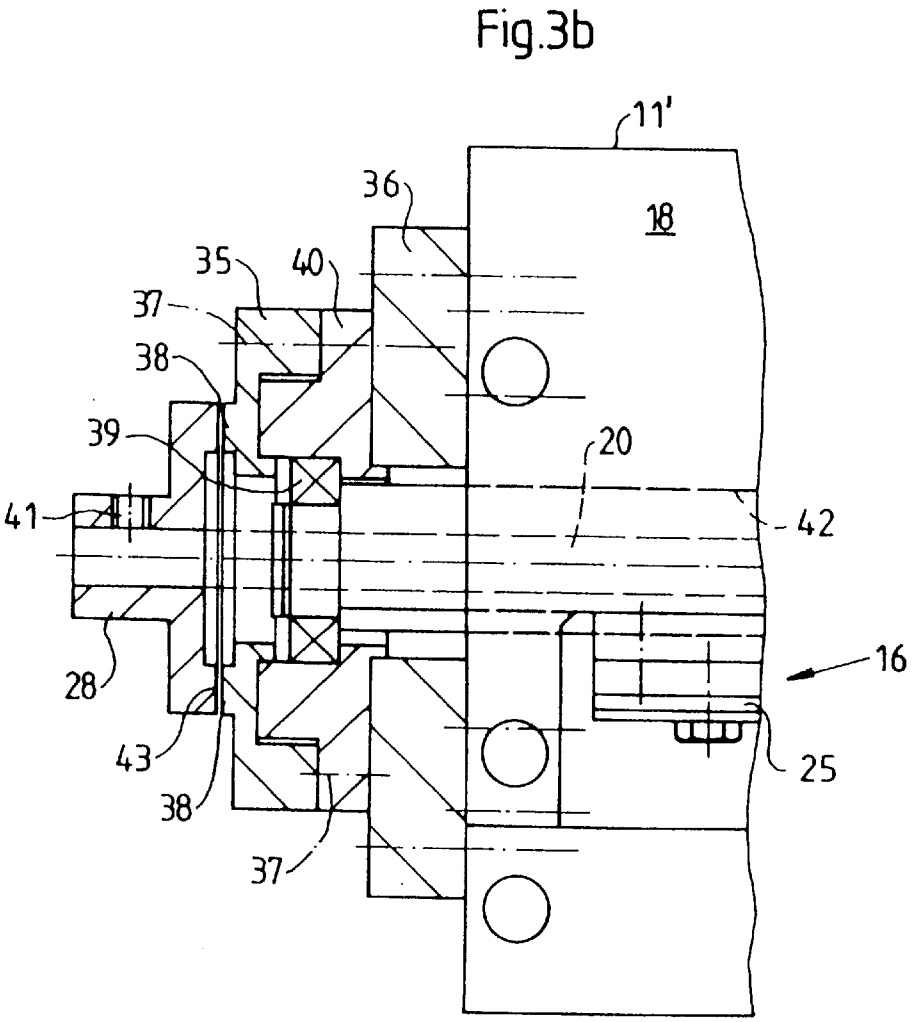
FIGS. 3*a*, 3*b* show a first embodiment of an adjusting device for applying a pre-determined torque to a torsion bar having a facial toothing.
Figure 3A:
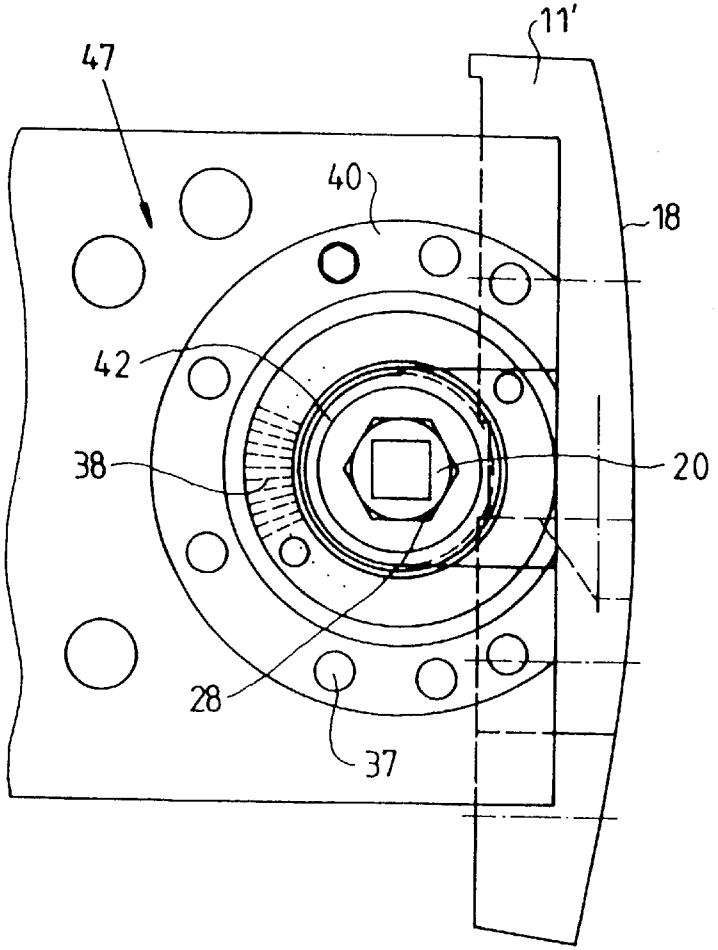

FIGS. 3*a, b* show an adjusting device 47 according to a first embodiment of the present invention having a facial toothing 38 and 43 on components 28 and 35 to maintain a preload torque. FIG. 3*a* shows a partial side view of a cylinder 11'. A torsion bar 20 (e.g., a torsion applying element), extends through the hollow interior of a mounting shaft 42. In this configuration, a number of tucking blades 25 (or jaws) are arranged on the mounting shaft 42. The torsion bar 20 is provided with a torque preloading element 28 (e.g. a hexagonal member) for receiving a torque wrench. In FIG. 3*b*, the torque preloading element 28 is shown mounted onto the torsion bar 20. A support 36 and a bearing element 40 are mounted on the cylinder 11' via fasteners 37 (e.g. screws). The bearing element 40 houses a bearing 39 which supports the mounting shaft 42 so that the mounting shaft 42 can rotate freely within the cylinder 11'. A ring-shaped element 35 having a facial toothing 38 is mounted on the bearing element 40. The torque preloading element 28 similarly includes a facial toothing 43 and is mounted on an end portion of the torsion bar 20 as shown. As the torque preloading element 28 is rotated counterclockwise across the facial toothing 38, the torque of the torsion bar 20 is preloaded. Moreover, the pitch of the facial toothing 38, 43 allows the preloaded torque of the torsion bar 20 to be finely tuned. For example, by rotating the torque preloading element 28 with a wrench (or other means) by one tooth, an increase or decrease of torque in the torsion bar 20 of about +/−5 ft lbs can be achieved. This fine pitch allows the operator to slightly increase or decrease the torque applied to the torsion bar 20 by rotating the element 28 in clockwise or counterclockwise direction. Naturally, the teeth 38, 43 separate sufficiently during preload adjustment to allow the element 28 to rotate relative to the element 35. The teeth 38, 43 are arranged so as to lock element 28 in position after the torque is preloaded by counterclockwise rotation of element 28.

The adjusting element 47 replaces the prior art torque loading mechanism 470. In order to preload a torque to the torsion bar 20, a torque wrench is used to apply a predetermined torque to the element 28. Then the torque wrench is applied to the second element 73 (shown in FIG. 2*c*) to measure the torque on the gear side end of the torsion bar 20. If the torque on the gear side end is incorrect, then, in accordance with the present invention, the torque can be fine tuned by rotating the element 28 tooth by tooth, until the torque measured on the gear side is correct. Consequently, unlike the mechanism 470 of FIG. 2*b*, the adjusting element 47 can readjust the torque on the torsion bar 20 without releasing the torque.

Figure 4B:
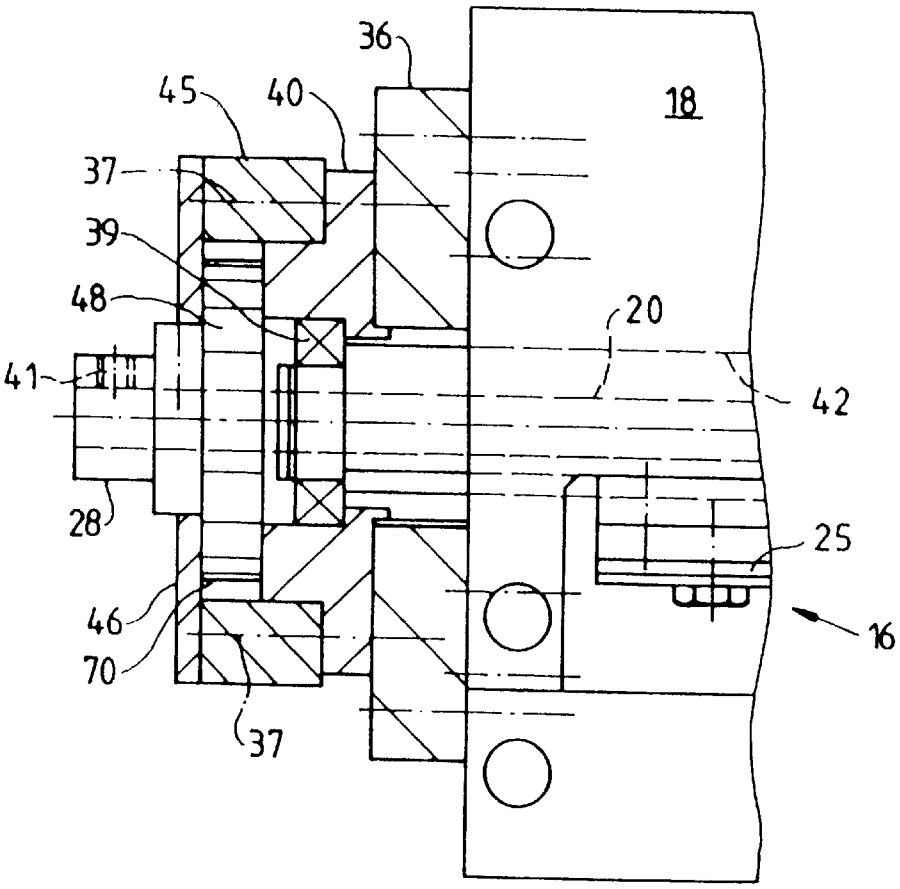
FIGS. 4*a*, 4*b* show a second embodiment of an adjusting device for applying a determined torque to a torsion bar having a ratchet.
Figure 4A:
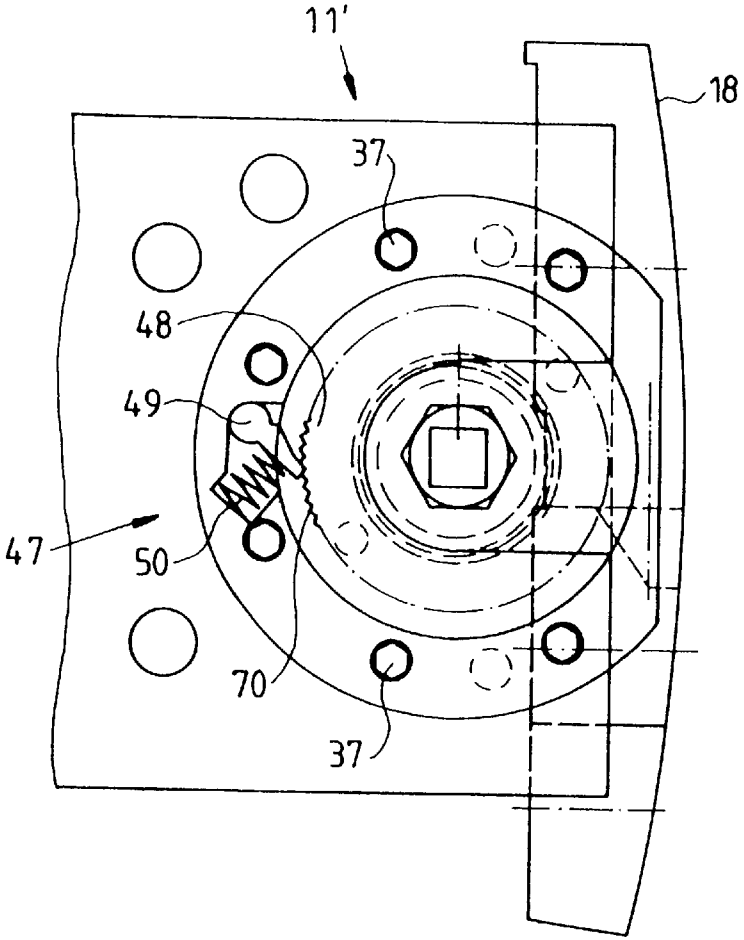

FIGS. 4*a, b* show an adjusting device 47 according to a second embodiment of the present invention for preloading a torsion bar 20 by means of a ratchet. FIG. 4*a* shows a partial front view of a tucking blade cylinder 11' (or jaw cylinder) having an adjusting device 47 assigned to its front side. A ratchet wheel 48 having a circumferential toothing (or partial toothing) applied thereto is mounted on the end portion of the torsion bar 20. Preferably, the toothing has a fine pitch. A spring loaded rotatably mounted pawl 49 is associated with the toothing of the ratchet wheel 48. The pawl 49 engages one or more teeth of the ratchet wheel 48 upon counterclockwise rotation of the ratchet wheel 48. The ratchet wheel 48 can be rotated by a wrench engaging the torque preloading element 28. The element 28, in turn, is fastened to the end portion of the torsion bar 20. The pitch of the toothing of the ratchet wheel 48 allows for fine tuning of the torque applied to the torsion bar 20. A spring 50 engaging the pawl 49 is mounted within a ring-shaped element 45. The ring shaped element 45 is mounted to the bearing element 40 and the support 36 by fasteners 37. Thus, once a torque is preloaded to the torsion bar 20 by counterclockwise rotation of the ratchet, clockwise rotation of the ratchet wheel 48 is blocked by the pawl 49. Since the toothing 70 on the circumference of the ratchet wheel 48 has a very fine pitch, the adjusting device 47 can provide very sensitive adjustment of the preloading torque by rotating the ratchet counter-clockwise tooth by tooth. For example, it has been found that this design can provide adjustment on the order of +/−5 ft lbs. The pawl may include a release mechanism (not shown) to allow the ratchet wheel 48 to rotate clockwise by one or more teeth if the torque is too high.

Referring to FIG. 4*b*, the torsion bar 20 upon which the ratchet wheel is mounted extends through the hollow interior of the mounting shaft 42. The mounting shaft 42 has tucking blades 25 (or jaws) mounted thereon. To the front side of the cylinder there is attached a support 36. Bearings 39 are mounted within a bearing housing 40 which, is turn, is mounted on the support 36. The ratchet wheel 48 is surrounded along its circumference by a ring shaped element 45, which, in turn, is mounted to the bearing housing 40. A plate 46 is mounted to the ring shaped element by fasteners 37, thereby covering the exterior side of the ratchet wheel 48. The fasteners 37 further extend through the bearing housing and into the support 36. Naturally, separate fasteners could alternatively be used to mount the cover plate 46 to the ring shaped element 45.

Figure 5B:
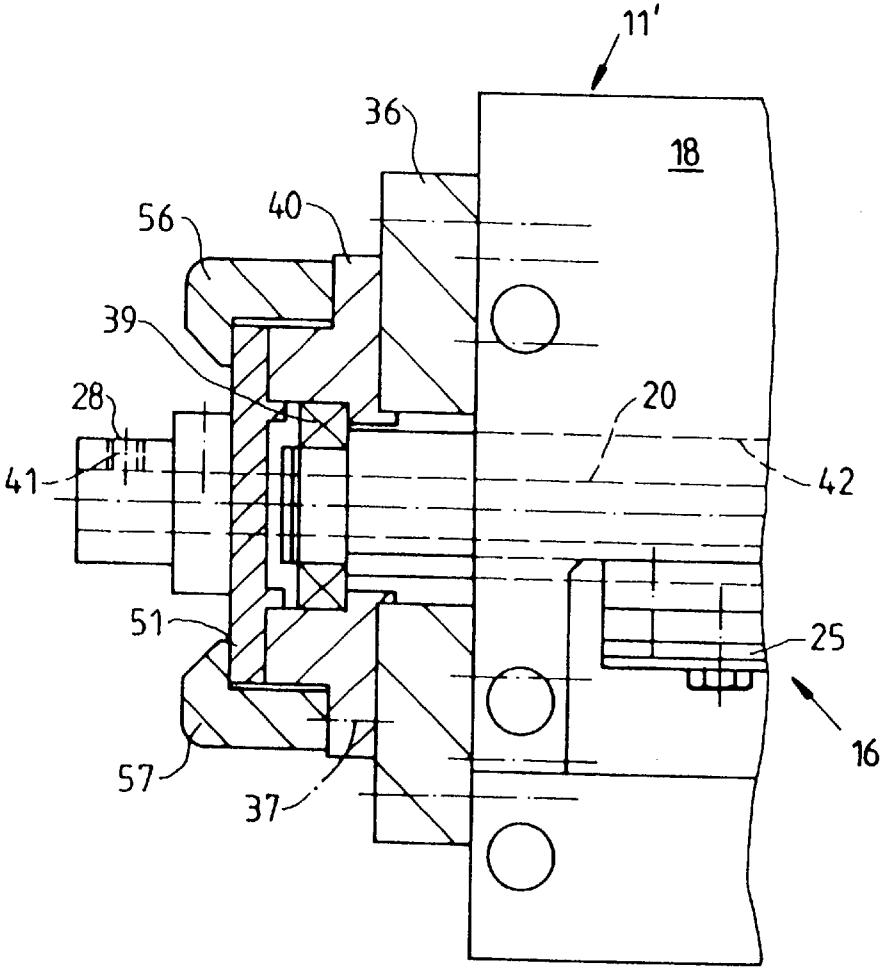
FIGS. 5*a*, 5*b* show a third embodiment of an adjusting device for applying a determined torque to a torsion bar having a latch design.
Figure 5A:
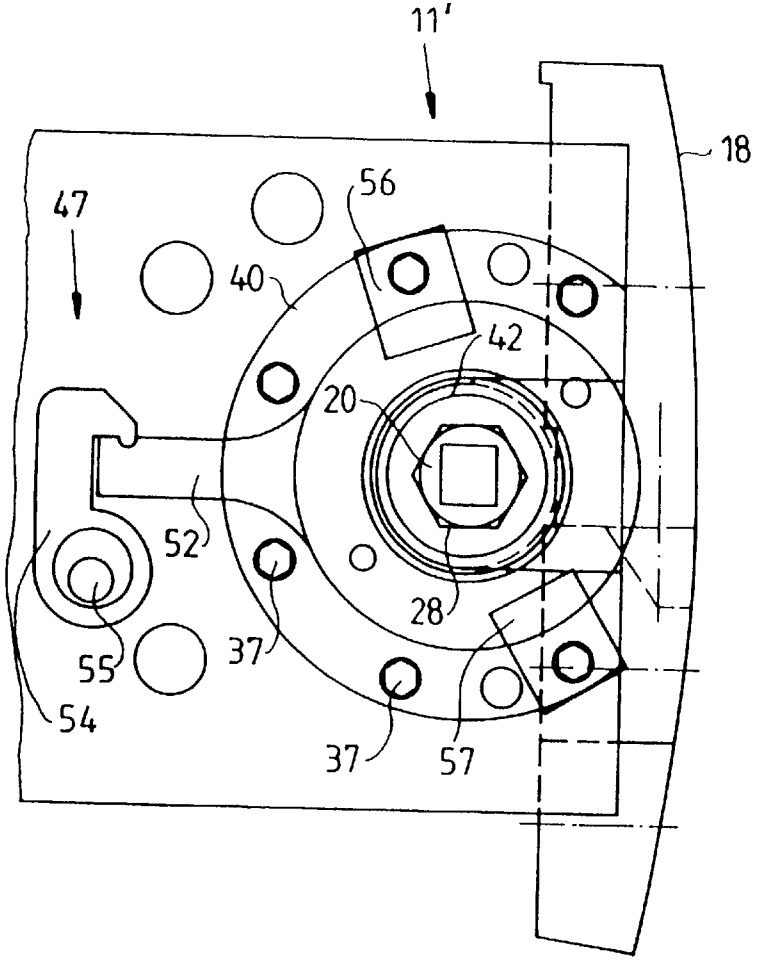

FIG. 5*a, b* shows a third embodiment of an adjusting device 47 according to the present invention. The torsion bar 20 is assigned to tucking blade cylinder 11' (or jaw cylinder). On the workside end of the torsion bar 20, the torque preloading element 28 is mounted. The torsion bar 20 extends axially through the mounting shaft 42 as described above with regard to FIGS. 3 and 4. A disc-shaped element 51 having a radially extending arm 52 and a preload element 28 is mounted to the workside end of the torsion bar 20. The arm 52 is engaged with a latch 54 which is rotatably mounted on an eccentric 55. As described above with regard to FIG. 4*b*, a support 36 is attached to the front side of the cylinder 11'. Bearings 39 are mounted within a bearing housing 40 which, is turn, is mounted on the support 36. The shaft 42 is rotationally mounted within the bearings 39. Gibbs 56, 57 are mounted to the bearing housing 40 by fasteners 37, and serve to guide the movement of the rotatably mounted disc 51. As shown, the disc 51 has an annular face which rests within the interior of the bearing housing 40.

As described above with regard to FIGS. 3 and 4, a torque can be preloaded on the torsion bar 20 by applying a torque wrench to the torque applying element 28. Once the torque is preloaded, the latch is engaged with the arm 52. Then, the torque can be fine tuned by adjusting the eccentric 55 as follows. Movement of the eccentric 55 causes a corresponding vertical movement of the latch 54, which, in turn, adjusts the rotational position of the disc 51 via the arm 52. Rotational movement of the disc 51 adjusts the preload torque applied to the torsion bar 20. Once adjusted, the torque may be removed, for example, in order to perform maintenance on the cylinder, and then reapplied without readjusting the position of the eccentric.

Figure 6:
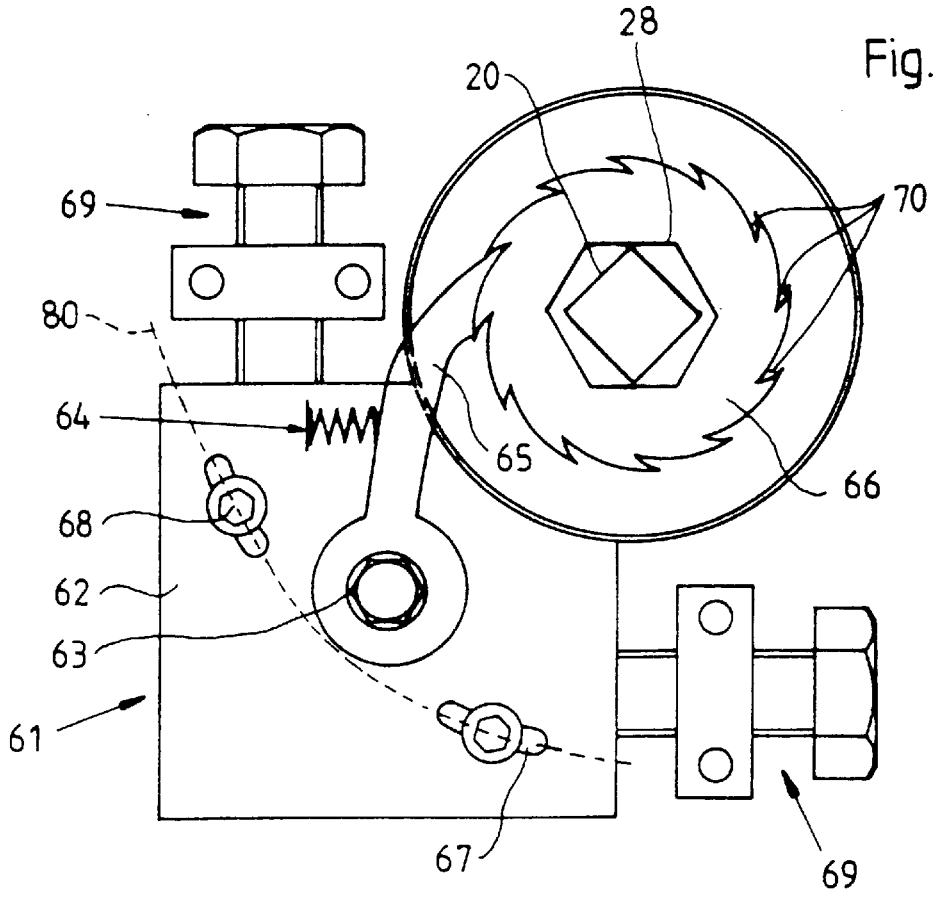
FIG. 6 shows a fourth embodiment of an adjusting device mounted on a rectangular plate which is movable via jacking screws.

FIG. 6 shows an adjusting device 61 according to a fourth embodiment of the present invention. In accordance with this embodiment, the adjusting device 61 includes a plate 62 which can be moved along an arc 80 by jacking screws 69. The arc 80, for example, may be concentric with the center of rotation of the shaft 42 and/or torsion bar 20. The plate 62 includes slots 67 for receiving bolts 68 which allow movement of the plate 62. A pawl 65 is mounted to the plate 62, and engages one or more teeth 70 of the ratchet wheel 66 upon counterclockwise rotation of the ratchet wheel 66. Preferably, the toothing has a fine pitch. The ratchet wheel 66, in turn, is mounted to the torsion bar 20 in the same manner as described above with regard to FIGS. 5*a,b*. The ratchet wheel 66 and torsion bar 20 can be rotated by applying a wrench to the torque preloading element 28. Once a torque is preloaded to the torsion bar 20, rotation of the ratchet wheel 66 is blocked by the pawl 65. The pawl 65 is mounted with a shoulder bolt and tensioned, for example, by a spring 64.

In order to preload a torque to the torsion bar 20, a torque wrench is used to apply a predetermined torque to the element 28. Then the torque wrench is applied to the second element 73 (not shown) to measure the torque on the gear side end of the torsion bar 20. If the torque on the gear side end is incorrect, then, in accordance with the present invention, the torque can be fine tuned by rotating the element 28 tooth 70 by tooth 70, until the torque measured on the gear side is correct. Moreover, even finer adjustments to the torque can be accomplished by varying the position of the plate 62 by turning the jacking screws 69. Thus, rotational movements of the ratchet wheel 66 being smaller than the pitch of the toothing 70 can be achieved resulting in torque variations less than for example +/−5 ft lbs.

Figure 7:
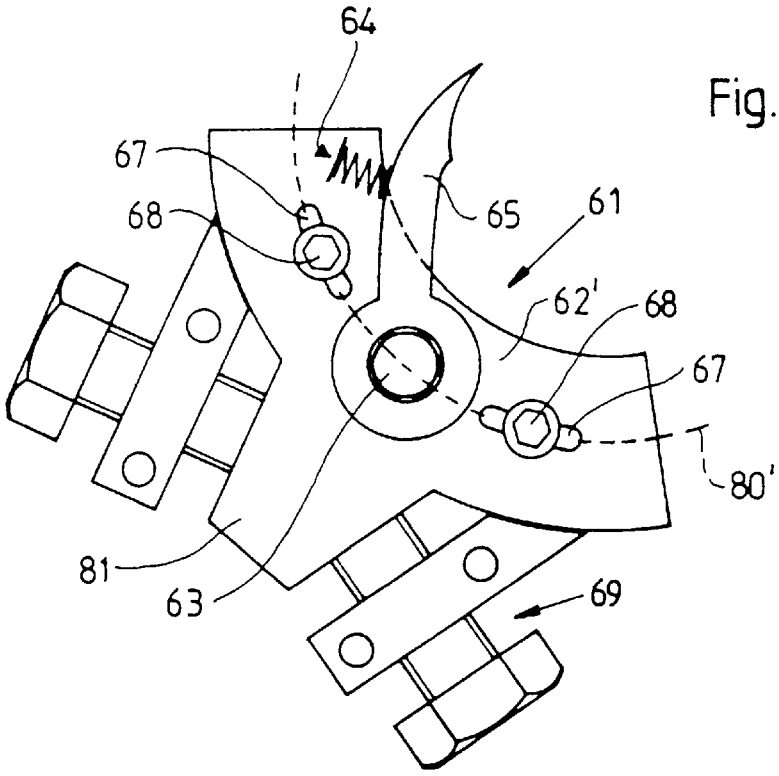
FIG. 7 shows a fifth embodiment of an adjusting device mounted on a arc-shaped plate which is movable via jacking screws.

FIG. 7 shows an adjusting device 61 according to a further embodiment of the invention. In accordance with this embodiment, the plate 62 is replaced with an arc-shaped plate 62' having slots 67. Bolts 68 are mounted within the slots 67 allowing movement of the plate 62' in an arc 80' via the slots 67. The pawl 65 is mounted approximately in the center of arc-shaped plate 62'. The jacking screws 69 abut an arm 81 of the arc-shaped plate 62' to allow for variation of the position of the arc-shaped plate 62'.

Figure 8A:
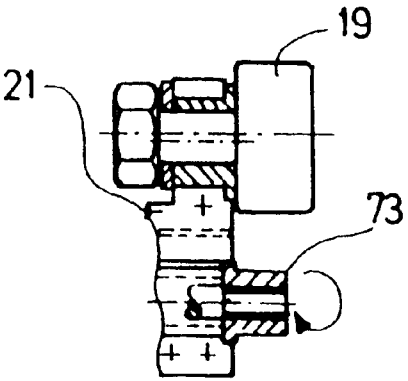
FIGS. 8*a*, 8*b* show the adjusting device according to FIGS. 4*a, b* using a ratchet design applied to a jaw shaft of a folding cylinder of a folding apparatus.
Figure 8B:
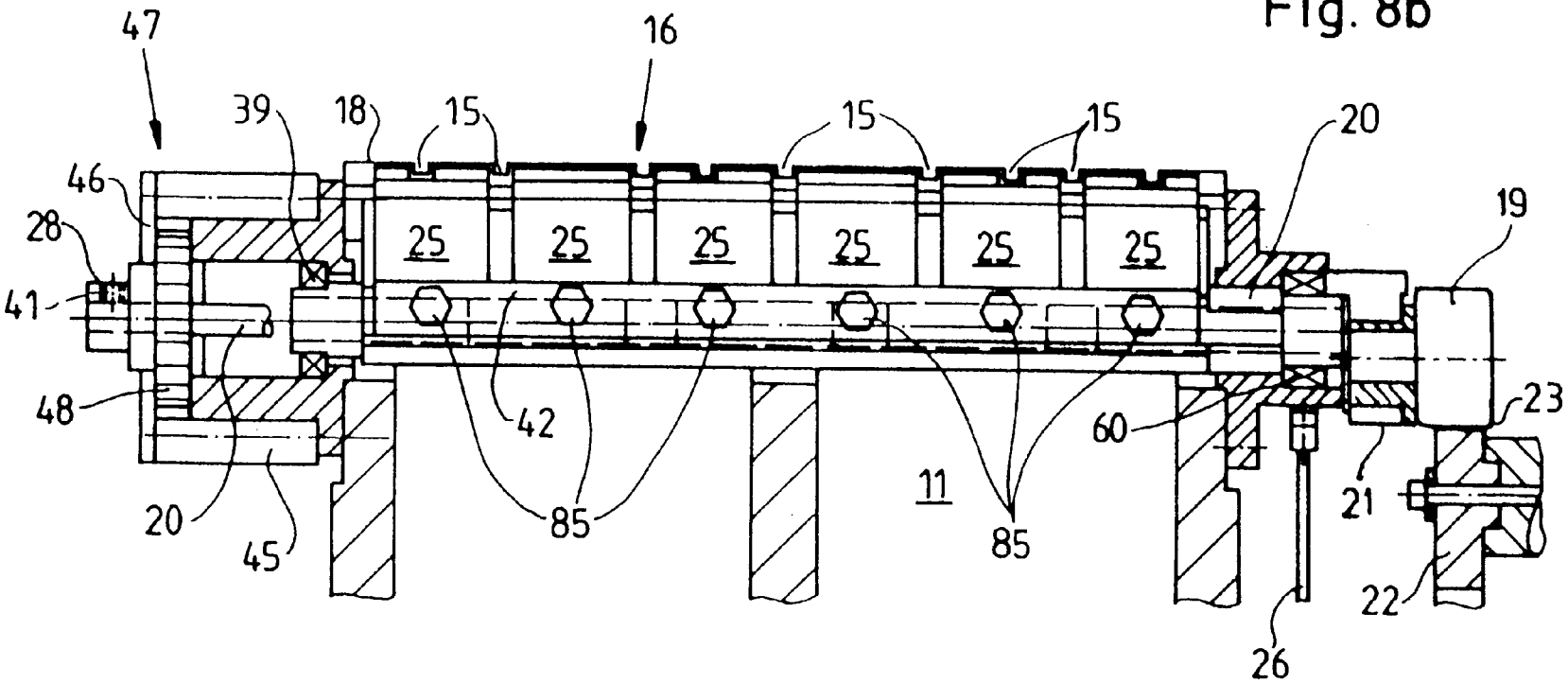

FIGS. 8(*a,b*) show two views of an adjusting device according to the present invention mounted on a workside end of a torsion bar. The adjusting device 47 shown corresponds to the embodiment of FIGS. 4*a, b*. For ease of illustration, the spring loaded pawl 49 and the spring 50 are not shown. Moreover, while the adjusting device 47 shown corresponds to the embodiment of FIGS. 4*a, b*, the adjusting devices of FIGS. 3, 5, 6, and 7 are equally applicable.

The torsion bar 20 extends through the hollow interior of the mounting shaft 42 and is attached to the torque preloading element 28 via set screw 41. The mounting shaft 42 is rotatably mounted in bearings 39 and 60. Movable jaws 25 are attached to the mounting shaft 42 by fasteners 85. As the shaft 42 rotates, the movable jaws 25 cooperate with respective fixed jaws on the surface 18 of the jaw cylinder 11 to grip and release printed products. The bearing 60 is lubricated by oil supply 26 to maintain a smooth rolling engagement of the shaft 42. As discussed above with regard to FIGS. 4*a,b*, the torque preloading element 28 applies a torque to the ratchet wheel 48. The ratchet wheel 48 is encapsulated by a ring 45 and a plate 46. Referring to FIG. 4*a*, the ratchet wheel 48 has an outer toothing which engages the pawl 49.

In order to preload a torque to the torsion bar 20, a torque wrench is used to apply a predetermined torque to the element 28. The application of a torque to the torsion bar 20 forces the cam follower 19 against the cam surface 23 of the cam 22. Once a predetermined torque is applied to the element 28 (as indicated by the torque wrench), the torque wrench is applied to the second element 73 (shown in FIG. 8(*a*)) to measure the torque on the gear side end of the torsion bar 20. If the torque on the gear side end is incorrect, then, in accordance with the present invention, the torque can be fine tuned by rotating the element 28 tooth by tooth, until the torque measured on the gear side is correct.

What is claimed is:

1. A cylinder in a folding apparatus including a plurality of product seizing devices comprising:

a cam;

a shaft having a plurality of product seizing devices attached thereto, a cam follower mounted to the shaft;

a torsion bar coupled to the cam follower;

a torque preloading element connected to the torsion bar for applying a preloaded torque to the torsion bar, the preloaded torque maintaining the cam follower in contact with the cam;

a mechanism for incrementally adjusting and maintaining the preloaded torque on the torsion bar, the mechanism including an adjustment member, an eccentric and a latch, the adjustment member being attached to the work side end of the torsion bar, the adjustment member having a radially extending arm, the latch having a first end engageable with an outer end of the radially extending arm and having a second end engaged with the eccentric, the preloaded torque on the torsion bar being incrementally adjusted by movement of the eccentric while the first end of the latch is engaged with the outer end of the radially extending arm.

2. The cylinder according to claim 1, wherein the mechanism is arranged on a work-side end of the cylinder.

3. The cylinder according to claim 1, wherein the eccentric is mounted to a work side end of the cylinder.

4. The cylinder according to claim 1, wherein the adjustment member is a disc shaped member having the radially extending arm.

5. The cylinder according to claim 1, wherein the plurality of product seizing devices are tucking blades.

6. The cylinder according to claim 1, wherein the plurality of product seizing devices are movable jaws.

7. The cylinder according to claim 1, wherein the plurality of product seizing devices are gripper elements.

8. The cylinder according to claim 1, further comprising a torque measuring element coupled to a gear side end of the torsion bar.

9. The cylinder according to claim 1, wherein the torque preloading element is configured to receive a torque wrench.

10. A cylinder in a folding apparatus including a plurality of product seizing devices, comprising:

a cam;

a shaft having a plurality of product seizing devices attached thereto, a cam follower mounted to the shaft;

a torsion bar coupled to the cam follower;

a torque preloading element connected to the torsion bar for applying a preloaded torque to the torsion bar, the preloaded torque maintaining the cam follower in contact with the cam, wherein the torque preloading element includes a first facial toothing on an interior face thereof;

an opposing ring shaped element, an exterior face of which contacts the interior face of the torque preloading element, wherein the exterior face of the opposing ring shaped element includes a second facial toothing, and wherein the first facial toothing engages the second facial toothing so that the preloaded torque on the torsion bar is incrementally adjusted by relative movement between the first and second facial toothings; and a mechanism for incrementally adjusting and maintaining the preloaded torque on the torsion bar.

11. The cylinder according to claim 10, wherein the opposing ring shaped element is mounted to a work side end of the cylinder.

12. The cylinder according to claim 10, wherein a pitch of the toothing is set to provide preload torque variations of approximately +/−5 ft. lbs. per tooth.

* * * * *